US006080047A

United States Patent [19]

Puertas Luzan

[11] Patent Number: 6,080,047

[45] Date of Patent: Jun. 27, 2000

[54] PROCEDURE FOR THE SURFACE TREATMENT OF PETROUS MATERIALS

[75] Inventor: Gregorio M. Puertas Luzan, Tudela, Spain

[73] Assignee: Industrial Marmolera, S.L., Spain

[21] Appl. No.: 09/036,843

[22] Filed: Mar. 9, 1998

[30] Foreign Application Priority Data

Mar. 7, 1997 [ES] Spain ..... 9700503

[51] Int. Cl.[7] ..... B24B 1/00

[52] U.S. Cl. ..... 451/59; 451/103; 451/109; 125/25

[58] Field of Search ..... 404/93, 94, 122; 125/25, 26, 27, 30.01, 38; 451/103, 109, 110, 111, 59

[56] References Cited

U.S. PATENT DOCUMENTS

| | | | |
|---|---|---|---|
| 601,676 | 4/1898 | Prescott | 125/26 |
| 1,813,014 | 7/1931 | Bankson | 125/26 |
| 2,453,339 | 11/1948 | Peterson | 451/109 X |
| 3,596,578 | 8/1971 | Jones . | |
| 4,646,479 | 3/1987 | Walker et al. | 451/59 |
| 4,759,658 | 7/1988 | Manor | 404/93 |
| 5,575,704 | 11/1996 | Hotani | 451/59 X |
| 5,775,977 | 7/1998 | Platzer et al. | 451/59 X |

*Primary Examiner*—Timothy V. Eley
*Attorney, Agent, or Firm*—Ostrolenk, Faber, Gerb & Soffen, LLP

[57] ABSTRACT

A process for surface treating the surface of petrous materials comprises applying friction to the surface to be treated by means of brush bristles which produce progressive erosion of the surface wherein the erosion is of greater depth in zones of lesser hardness. The process removes parts of lesser consistency from the surface. The process is performed without chemical treatment, sand blasting or the application of fire to texture and may be performed in the presence of water.

11 Claims, No Drawings

PROCEDURE FOR THE SURFACE TREATMENT OF PETROUS MATERIALS

BACKGROUND OF THE INVENTION

The present invention refers to a procedure for the treatment of petrous material surfaces, applicable especially, although not exclusively, to obtaining textures with aged appearance on those surfaces.

The invention is applicable to any type of petrous materials such as marbles, stones, travertines, slates, etc.

It is already known to produce textures of aged appearance on surfaces of petrous materials, by the application of chemicals, by sand blasting or by the application of fire by means of torches.

The application of effective chemicals to obtain these textures presents possible risks to persons and to the environment, both during their elaboration and during their use and removal, is generally either or both hazardous for the treated materials and very expensive in their application. On the other hand, massive use of the these products, when there may be a risk to persons or to the environment, requires strict training of the operators for the use and treatment with the products.

Application by sand blasting requires a high cost to obtain textures which are acceptable, and a reduced production is achieved, in addition to the limitations regarding the textures to be obtained and the materials which are susceptible to being treated with acceptable results.

Finally, the application of fire by applying torches on so-called granites is applicable to practically all such materials, but can be applied with acceptable results only on a limited number of marbles, stones and other coped petrous materials. On the other hand, the texture which results from this procedure, though rustic or rough, is not considered aged.

SUMMARY OF THE INVENTION

The object of the present invention is to provide a procedure for surface treatment of petrous materials which solves the previously indicated problems and produces treated surfaces which are capable of representing different aged textures.

The invention concerns a process for surface treating the surface of petrous materials comprising applying friction to the surface to be treated by means of brush bristles which produce progressive erosion of the surface, wherein the erosion is of greater depth in zones of the surface of lesser hardness. The process removes parts of lesser consistency from the surface. The process is performed without chemical treatment, sand blasting or the application of fire to texture and may be performed in the presence of water.

The procedure of the invention is also applicable to grinding and polishing of faces and edges, as well as to removal of zones with little or no consistency for subsequent scaling.

DETAILED DESCRIPTION OF THE INVENTION

According to the present invention, the surface or surfaces of the petrous material to be treated is progressively eroded by application of brushes with flexible bristles.

Preferably, the bristles are metallic and the brushes may adopt any configuration, with a circular, cylindrical, flat etc. distribution. The nature of the bristles, their flexibility and caliber shall depend on the type of petrous material which is going to be treated and on the desired texture to be obtained.

When the surface of the petrous material is rubbed with the brushes, abrasions of different degrees are produced, depending on the type of material which is elaborated, on the type of material from which the brush filaments are made, on their flexibility, their section, the quantity and the manner of assembly on which the brush acts, the shape of the brush, the rotation speed of the brush carrier plate and the pressure with which the brush is applied on the surface to be treated.

The procedure of the invention enables both flat faces and edges to be elaborated, always permitting the abrasion which gives an aged appearance, which is similar to that acquired by petrous materials with the passage of time, both due to use and to the erosion of the natural elements through centuries and even millennia.

The procedure of the invention, as has been previously indicated, may be applied for obtaining diverse aged and/or rough textures on faces and edges, as from other semi-elaborations or elaborations of all types and among which are to be found the coped, ground, hammer shaped, blazed, picked, and natural faced ones, like slates and the like.

The invention is also applicable to those granites with ground and polished faces and edges with less fine textures than those in current classical systems. By means of the procedure of the invention, combined with the classic procedure, a grinding, polishing and gloss which is less bright than that obtained by traditional methods is achieved, which offers another aesthetic quality, capable of commercialization.

The procedure of the invention is applicable also to the removal of parts with little or no consistency. Some coped petrous materials have characteristics which require scaling the material by means of the so-called mastique, with which it is intended to repair or reinforce the brittle materials or materials with compactness problems, by means of the application of diverse types of mastiques (based on resins, cements and other suitable products for the same), in cokes, hole-throughs, limestone seams, parts without consistency, hairs or open joints. Some of the most suitable marbles for the application of these procedures are: The Ivory Cream (possibly the marble with greatest production and used in Spain), Red Alicante, Emperor or Imperial Brown, Coralite Red, Cehejin Red and Grey.

Cleaning and removal of parts with little or no consistency is also done on the rear face of marble slabs of the previously indicated type. This requires the application of the reinforcement by means of the tiling and resin application, so that, once the procedure of the invention has been performed, the rear faces of the slabs are free of parts without consistency and in consequence, are open to receive and be filled (cokes, cracks, joint zones, etc.) by the resin. The improvement by the present application system of reinforcement by means of the tiling and resin application is clear, since the effectiveness of the current reinforcement is appreciably potentiated. With the present known system, the reinforcement is applied superficially, creating undesired effects. The improvements resulting from use of the procedure of the invention are evident. It permits the reinforcement to also be internal which makes the resin (when hardened) form one single body between the surface and the internal part (the voids left by the parts without consistency). This causes the grip of the resin to be much greater and in consequence, decreases, almost totally, the risk of debonding. On the other hand, it internally reinforces the material by consolidating the internal parts, which had previously been occupied by components of the marble with little or zero consistency. It also produces the characteristic which is so well known by marble workers and which is not positive in marbles, such as the Ivory Cream and the like, comprising embrittlement which is innate to the greater part of the production of the same.

The application and embodiment of the procedure of the invention avoids the risks of any of the existing aging systems, since it does not use chemicals for the abrasion of the petrous material. Also, it does not require special training of personnel who are to conduct the process, since it may be used by operators who have been instructed in traditional polishing.

The procedure of the invention simplifies and shortens the times and steps for aiming the desired textures, as compared with traditional systems, and does not internally damage the materials dealt with.

The procedure of the invention may be applied by traditional machines used, for example, in marble working, without requiring essential modifications and without detriment to the use for which those machines have been conceived.

The bristles of which the brushes are comprised may be also adapted to rollers and tabs. Additionally, so-called industrial diamond may be used to adapt it to the points or other parts of the flexible wires which make up the brush. In forming the brushes, metal or steel bristles may be used, which are more resistant to wear and which produce the same or similar textures. Other non-metallic materials may also be used as abrasive bristles. The bristles may offer different degrees of flexibility to be adapted to machines with fixed pressure heads, both in the plate version and in the roller version.

The bristles or filaments which form the brush may also be plaited or attached by one of their ends to a support with a flat or cylindrical surface, as the brush is capable of adopting any of the traditional systems for attachment to the plate of the activation tool.

The basis of the procedure of the invention and the results obtained with the procedure are now described:

Almost all petrous materials are diverse in their composition and hardness. Additionally, many materials present varied characteristics, such as the cokes in the travertines, the limestone seams, with little consistency, in the materials of Eastern Spain, the different components which form materials such as the Emperors, the grey Phyllite, the serpentine green materials, etc.

When the materials are attacked by abrasive or erosive means, of whichever type, it is observed that the softer parts and parts with less consistency disappear, the middle hardness parts also do the same, though in less degree, and the hardest parts are the ones which are less worn. All this, and after being subjected to a specific erosion, offers a more or less irregular texture, depending on the material treated, and gives an appearance of aged material.

The procedure, after analyzing and researching the probable result (complexity, feasibility, final cost, etc.) of diverse procedures of attack by erosion, are based on the erosion of petrous materials, in a machined manner, with tools made up of materials with diverse degrees of flexibility and which are capable of performing unequal wear, depending on the inequality of the composition of a same material and in other cases, on a prior semi-elaboration and on the commencement from an already irregular face, such as a blazed, shaped, or picked face, or of a face with natural texture such as slates, quartzite and the like.

The flexibility of the attacking element, in its form (filament), and the pressure exerted by the head on the face of the stones, makes it possible that the greater is the number of times the head passes over the surface, the greater is the erosion of the soft parts of materials with diverse composition (heterogenous). In the blazed, shaped and picked, what is intended (especially) is to wear away the projecting parts in greater measure and the sunken parts to a lesser degree, so that the surface seems to have been worn by normal use. Due to the combination of the pressure with the flexibility and the shape of the filaments of the attacking element, the objective is achieved, because the entire surface is attacked, the parts which project most are the most worn, since they are subjected to more pressure. Another of the results of the characteristics of the tool, is that the differences between the most prominent parts and the most sunken parts is characterized by their smoothness.

This same combination of flexibility and pressure explains obtaining the rounded or smoothed edges or corners. If additionally, and previously, the edges are holed, breaking the edges, the holes are worn which gives an increased sensation of antiquity. These options have been demonstrated, with optimum results in all cases.

The procedure of the invention may be performed while providing water during the actuation of the brush on the petrous material.

An additional advantage of the procedure of the invention is that it may be carried out either in the work-shop or on site, and even after the petrous material has been placed.

Finally, the new procedure hereof as opposed to the chemical systems, not only does not damage the material (stones, marbles, etc . . . ) but also improves the physico-mechanical characteristics of the batch in general. This is because it is a mechanical procedure (100%) that does not alter the molecular structure or composition of the material, and on the other hand, since the abrasion is conducted on the surface and due to the characteristics of the tool (flexible filaments) the lesser consistency parts are eliminated from the surface, up to 1 or 2 mm depth. As a result on the one hand, the parts of less quality break and are invalidated, and on the other hand, the resultant surfaces (in their totality) are more resistant during use than surfaces of classical elaboration.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A process for surface treatment of petrous materials for obtaining texture with aged appearance, the process comprising applying friction to the surface to be treated by applying brush bristles which produce progressive erosion of the surface during the applying, with increasing intensity or depth of the erosion dependent upon decrease of hardness of the petrous materials at specific points or zones over the material being treated.

2. The process of claim 1, wherein the brush bristles are metallic.

3. The process of claim 1, wherein the application of friction by brushing is performed without application of chemicals for texturing, sand blasting for texturing or application of fire for texturing.

4. The process of claim 3, wherein the texturing by friction is performed in the presence of water applied on the surface being textured.

5. The process of claim 1, wherein the texturing by friction is performed in the presence of water applied on the surface being textured.

6. The process of claim 1, wherein the surface of the petrous material is eroded by the brush bristles so that the parts of the surface which project most are the most worn and the parts of the surface which project more are made smoother than the parts of the surface that project less.

7. The process of claim 6, wherein the surface of petrous material being treated has parts of lesser consistency, parts of middle hardness and still harder parts and the erosion by bristles is performed until the parts of lesser consistency disappear, the parts of middle hardness mostly disappear to a lesser degree than the parts of lesser consistency and the harder parts are less worn.

8. The process of claim 1, wherein the surface of petrous material being treated has parts of lesser consistency, parts of middle hardness and still harder parts and the erosion by bristles is performed until the parts of lesser consistency disappear, the parts of middle hardness mostly disappear to a lesser degree than the parts of lesser consistency and the harder parts are less worn.

9. A process for surface treatment of petrous materials for obtaining texture with aged appearance, wherein the petrous material has a surface including zones thereon with a lesser consistency and lesser hardness, with a middle hardness and with harder parts, the process comprising applying friction to the surface of the petrous material over the zones thereof of different hardness by applying the brush bristles to the surface which produce progressive erosion of the surface during the applying of the bristles, wherein the number of passes of bristles over the zones of the petrous material, the material, diameter and flexibility of the bristles, the pressure applied by the bristles to the surface are all selected to produce progressive erosion of the surface with increasing intensity or depth depending upon the degree of hardness and the consistency of the petrous material at the surface at the zones over the material being treated.

10. The process of claim 9, wherein the surface of the petrous material is eroded by the brush bristles so that the parts of the surface which project most are the most worn and the parts of the surface which project more are made smoother than the parts of the surface that project less.

11. The process of claim 10, wherein the surface of petrous material being treated has parts of lesser consistency, parts of middle hardness and still harder parts and the erosion by bristles is performed until the parts of lesser consistency disappear, the parts of middle hardness mostly disappear to a lesser degree than the parts of lesser consistency and the harder parts are less worn.

* * * * *

UNITED STATES PATENT AND TRADEMARK OFFICE

CERTIFICATE OF CORRECTION

PATENT NO :6,080,047

DATED :June 27, 2000

INVENTOR(S) :Gregorio M. Puertas Luzan

It is certified that error appears in the above identified patent and that said Letters Patent are hereby corrected as shown below.

[73] Assignee: Union Industrial Marmolera, S.L., Spain

Signed and Sealed this

Fifteenth Day of May, 2001

*Attest:*

Nicholas P. Godici

NICHOLAS P. GODICI

*Attesting Officer*

*Acting Director of the United States Patent and Trademark Office*